US006778145B2

(12) United States Patent
Toland et al.

(10) Patent No.: US 6,778,145 B2
(45) Date of Patent: Aug. 17, 2004

(54) WIDEBAND ANTENNA WITH TAPERED SURFACES

(75) Inventors: Brent T. Toland, Manhattan Beach, CA (US); Kwok-Kee Chan, Brampton (CA)

(73) Assignee: Northrop Grumman Corporation, Los Angeles, CA (US)

( * ) Notice: Subject to any disclaimer, the term of this patent is extended or adjusted under 35 U.S.C. 154(b) by 16 days.

(21) Appl. No.: 10/190,358

(22) Filed: Jul. 3, 2002

(65) Prior Publication Data

US 2004/0004580 A1 Jan. 8, 2004

(51) Int. Cl.[7] ..... H01Q 13/00
(52) U.S. Cl. ..... 343/770; 343/767; 343/797
(58) Field of Search ..... 343/767, 770, 343/768, 786, 795, 797

(56) References Cited

U.S. PATENT DOCUMENTS 6,356,240 B1 * 3/2002 Taylor ..... 343/767
6,552,691 B2 * 4/2003 Mohuchy et al. ..... 343/770

OTHER PUBLICATIONS

Chan, K.K, et al., "Field Analysis of a Ridged Parallel Plate Waveguide Array," Proceedings of 2000 IEEE International Conference on Phased Arrays, May 21–25, 2000, pp. 445–448.

Chan, K.K. et al., "Field Analysis of A Ultra Broadband Wide Scan Dual Polarized Array of Ridge Elements," [complete reference unavailable].

Cooley, Michael E. et al., "Radiation and Scattering Analysis of Infinite Arrays of Endfire Slot Antennas with a Ground Plane," 1991 IEEE International Conference on Antennas and Propagation, Nov. 1991, pp. 1615–1625.

Holzmann, Eric L., "A Wideband TEM Horn Radiator with a Novel Microstrip Feed," Proceedings of 2000 IEEE International Conference on Phased Arrays, May 21–25, 2000, pp. 441–443.

Janaswamy, Ramakrishna, et al., "Analysis of the Tapered Slot Antenna," IEEE Transactions on Antennas and Propagation, vol. AP–35, No. 9, Sep. 1987, pp. 1058–1065.

Schaubert, Daniel H., et al., "Characteristics of Single–Polarized Phased Array of Tapered Slot Antennas," IEEE, Jun. 1996, pp. 102–106.

Schaubert, Daniel H., "A Class of E–Plane Scan Blindnesses in Single–Polarized Arrays of Tapered–Slot Antennas with a Ground Plane," IEEE Transactions on Antennas and Propagation, vol. 44, No. 7, Jul. 1996, pp. 954–959.

Shin, Joon, et al., "A Parameter Study of Stripline–Fed Vivaldi Notch–Antenna Arrays," IEEE Transactions on Antennas and Propagation, vol. 47, No. 5, May 1999, pp. 879–886.

Thiele, Eric, et al., "FD–TD Analysis of Vivaldi Flared Horn Antennas and Arrays," IEEE Transactions on Antennas and Propagation, vol. 42, No. 5, May 1994, pp. 633–641.

Schaubert, D.H., et al., "Measurement of Phased Array Performance At Arbitrary Scan Angles," 1994 Allenton Symposium, p. 43 [incomplete copy of article and complete reference unavailable].

Shin, J., et al., "Toward A Better Understanding of Wideband Vivaldi Notch Antenna Arrays," 1995 Allerton Symposium, pp. 556 and 579 [incomplete copy of article and complete reference unavailable].

* cited by examiner

*Primary Examiner*—Tan Ho
(74) *Attorney, Agent, or Firm*—Posz & Bethards, PLC

(57) ABSTRACT

An antenna array (10) comprises a plurality of antenna elements (20–32) creating a plurality of radio frequency waves. The central portion (185) of opposed edges of the waves are guided with conductive material. The waves are isolated from each other by non-conductive (cir or dielectric) spaces (189). The waves are guided by tapered surfaces (140, 141) having a predetermined thickness and emitted through a mouth having a mouth length (M). The ratio of the predetermined thickness to the mouth length is increased until there is no substantial increase in the high frequency limit of the array.

12 Claims, 12 Drawing Sheets

WIDEBAND ANTENNA WITH TAPERED SURFACES

BACKGROUND OF THE INVENTION

This invention relates to communications antenna arrays, and more particularly relates to such arrays used to communicate data over multi-octave bandwidths.

The current state of the antenna art is unable to provide an array element with the wide scanning and the multi-octave bandwidth needed for some applications. The multi-octave bandwidth typically needed is greater than 4 to 1. The current state of the art includes printed notches such as those described in "FD-TD Analysis of Vivaldi Flared Horn Antennas and Arrays" by E. Thiele, *IEEE Transactions On Antennas And Propagation*, Vol. 42, No. 5, May, 1994. Radio waves are guided by the printed notches. The printed notches have electric insulating material at their center. Thus, the central portion of the radio waves is guided by insulating material. The applicants believe that the exposed insulating material contributes to the deficiencies of such printed notches.

The current state of the art also includes a crossed ridge antenna developed at TRW such as shown in FIG. 1. In the TRW design, the crossed ridges are arranged in intersecting pairs. The applicants believe that such intersection contributes to problems encountered in some applications.

Both the printed notch and crossed ridge antennas have been found to support resonant modes, which seriously degrade scan performance at one or more frequencies in a multi-octave band. This phenomenon is known as scan blindness. These degradations render the array element unusable in many applications. This invention addresses the problem of scan blindness and provides a solution.

BRIEF SUMMARY OF THE INVENTION

The preferred embodiment includes an antenna array comprising a plurality of antenna elements. The elements cooperate to communicate radio frequency waves. Each element preferably comprises an element structure having a gap arranged to couple radio frequency energy. The element structure defines a gap plane bisecting the gap. A first tapered surface and a second tapered surface extend from the element structure to a mouth and are arranged to couple the radio frequency energy through the mouth. The first and second tapered surfaces define a first section of a first tapered-surface plane perpendicular to the gap plane and bisecting the first and second tapered surfaces. A first mid portion of the first tapered surface and a second mid portion of the second tapered surface intersect the first tapered-surface plane. The first section has a boundary defined at the periphery of the mouth, and the other elements in the array are arranged such that no other tapered-surface plane of another pair of tapered surfaces in the array intersects the first section. A conductive surface covers at least the mid portions of the tapered surfaces.

According to another embodiment, an antenna array is provided with a plurality of antenna elements capable of coupling a plurality of radio frequency waves. In such an environment, the waves preferably are communicated by guiding at least the central portion of opposed edges of the waves with a conductive material and by isolating the waves from each other.

According to another embodiment of the invention, at least a majority of the elements in the antenna array comprise an element structure having a gap arranged to couple radio frequency energy. The element structure defines a gap plane bisecting the gap. A surface having a predetermined thickness parallel to the gap plane extends from the element structure to a mouth defining a mouth length. The surface is arranged to couple the radio frequency energy through the mouth. The ratio of the predetermined thickness to the mouth length is such that there would be no substantial increase in the high frequency limit of the array if the ratio were increased.

According to another embodiment of the invention, at least a majority of the elements in the antenna array comprise an element structure having a gap arranged to couple radio frequency energy. The element structure defines a gap plane bisecting the gap. A surface having a predetermined thickness parallel to the gap plane extends from the element structure to a mouth defining a mouth length. In such an antenna, the antenna elements preferably are tuned by increasing the ratio of the predetermined thickness to the mouth length until there is no substantial increase in the high frequency limit of the array.

DETAILED DESCRIPTION OF THE INVENTION

Figure 1:
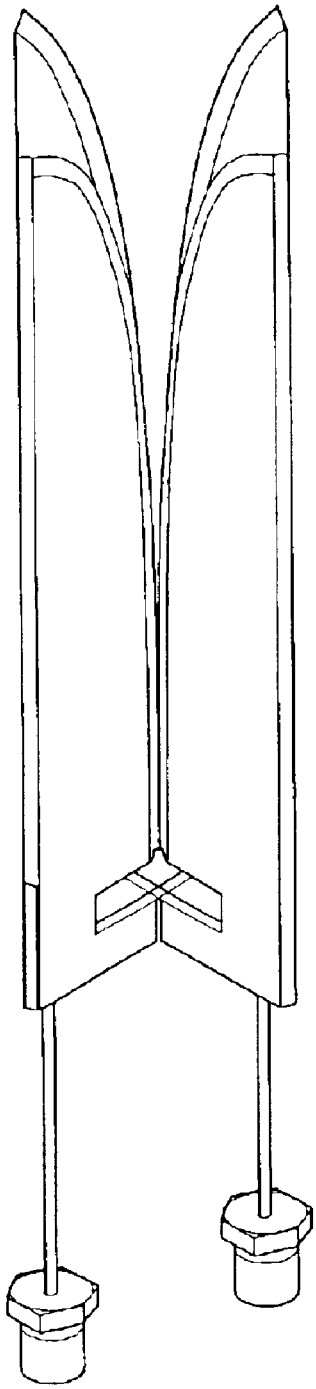
Figure 1 Prior Art
FIG. 1 illustrates a prior art crossed ridge antenna element.
Figure 2:
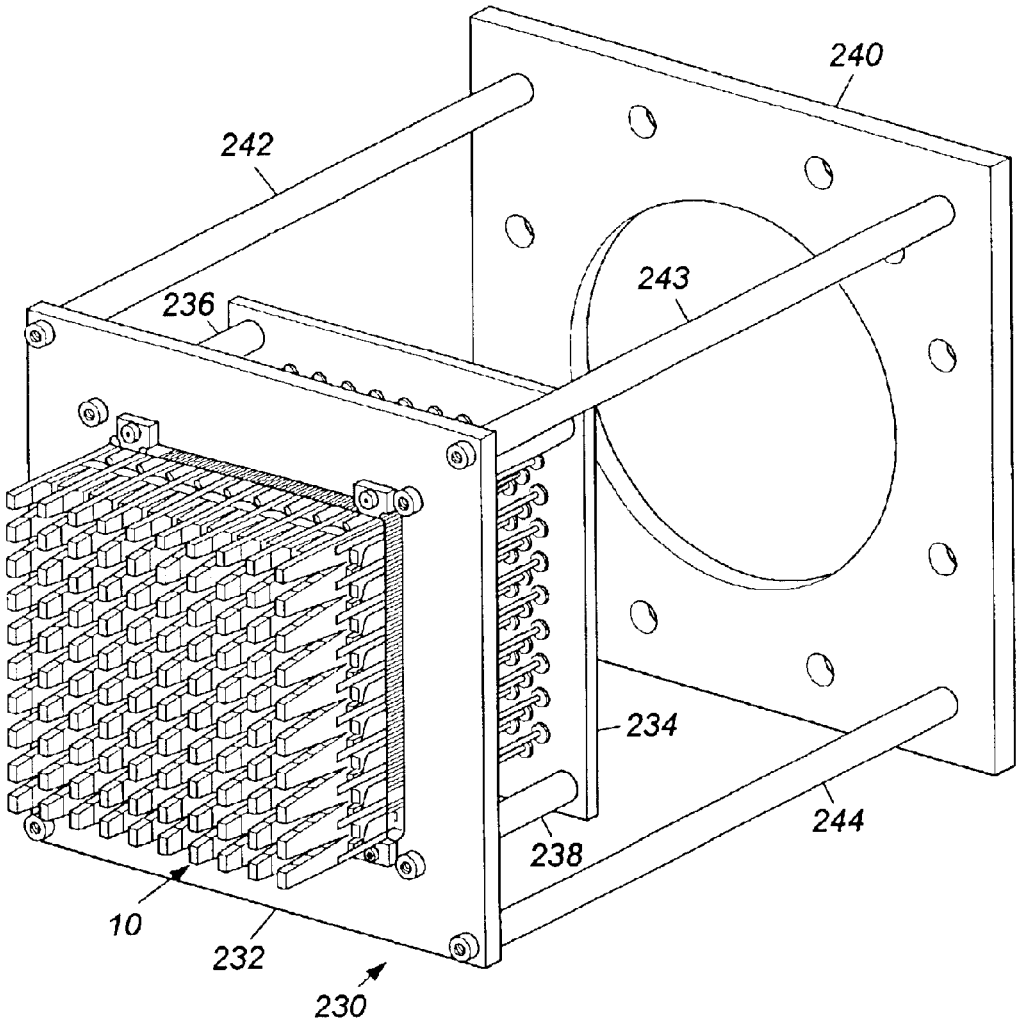
FIG. 2 is an isometric view of a preferred form of an antenna array and support module embodying the invention.

Referring to FIG. 2, the preferred embodiment basically comprises an antenna array 10 and a support module 230. Referring to FIGS. 3–7, array 10 includes 49 identical antenna elements, such as elements 20–32 shown in FIG. 3. The elements cooperate to communicate (e.g., transmit or receive) radio frequency waves. The elements are described in a transmit mode of operation. However, those skilled in the art will recognize that the elements may operate in a receive mode of operation by reversing the operation described for the transmit mode.

Exemplary element 21 is shown in more detail in FIGS. 4–7. Element 21 includes a plastic block 98 molded from Ultem®, manufactured by General Electric, which is covered with a conductive material, such as copper, gold, or the like. Block 98 forms a base 100, which defines a base top surface 101. Within base 100 are tuning chambers 102 and 104 ensuring that a radio frequency wave is reflected to the outside of the array.

Lead channels 106A, 106B, 108A and 108B are formed in base 100. The channels accommodate coaxial cable with a characteristic impedance of about 50 ohms.

Block 98 also forms an element structure 110 with parallel walls 112 and 113. The walls define a gap 116 that receives radio frequency energy from the coaxial cable. Structure 110 defines a gap plane 118 that bisects gap 116 as shown. Block 98 also forms an element structure 120 with parallel walls 122 and 123. The walls define another gap 126 that receives radio frequency energy from the coaxial cable. Structure 120 defines a gap plane 128 that bisects gap 126 as shown.

Block 98 also forms tapered surfaces 140 and 141 arranged as shown. The surfaces are formed from parallel wall pairs 142, 143; 144, 145; 146, 147 and 148, 149 arranged as shown. The parallel wall pairs are joined by coplanar wall pairs 152, 153; 154, 155; 156, 157; and 158, 159 arranged as shown. The wall pairs terminate in a mouth 162 having a mouth length M. The wall pairs each have a thickness T parallel to gap plane 118. Wall pairs 152–159 have increasing surface area and have an increased dimension perpendicular to plane 118 as they approach mouth 162. The wall pairs form stepped surfaces that have bilateral symmetry with respect to plane 118.

Figure 7:
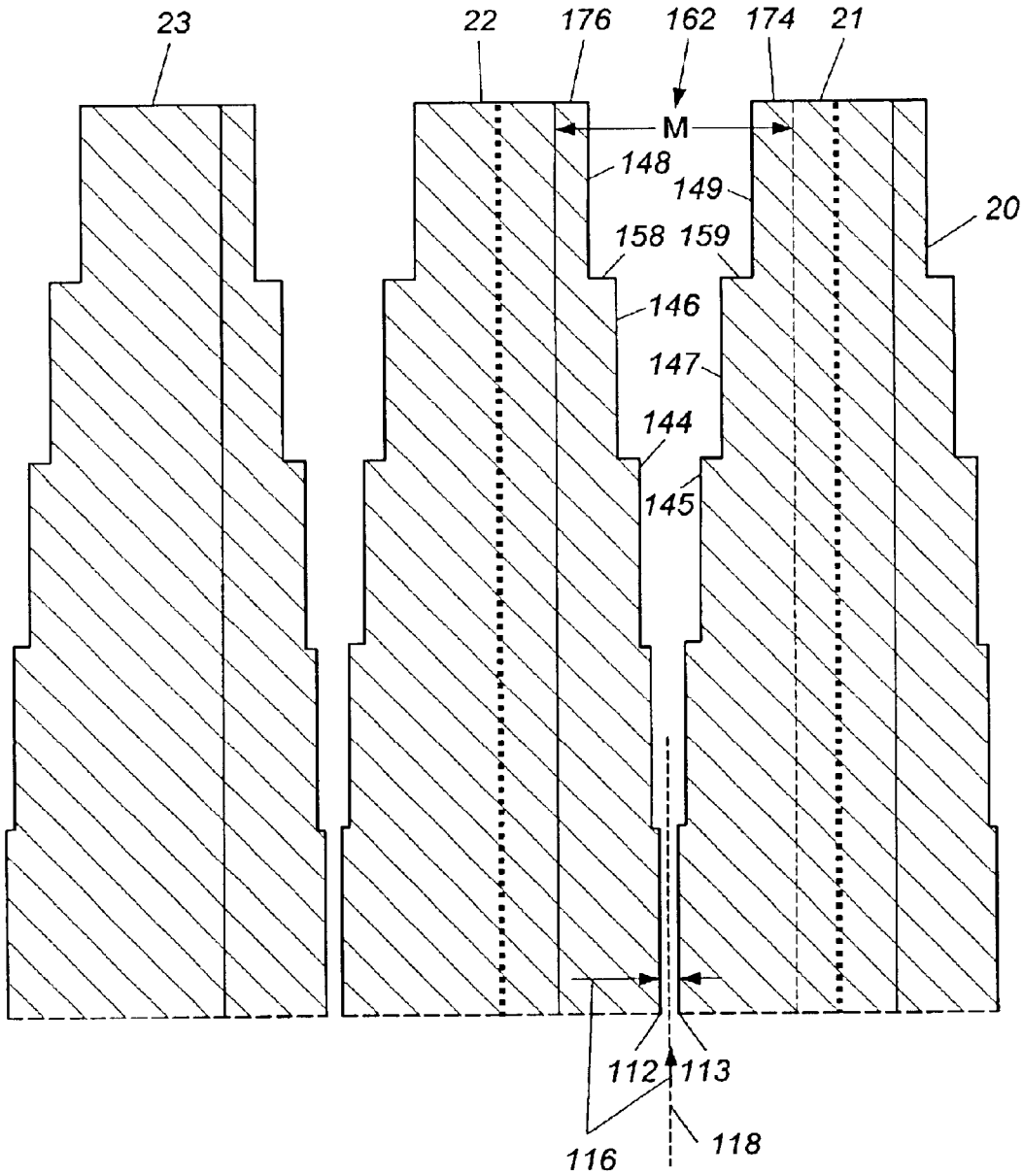
FIG. 7 is a fragmentary cross-sectional view of three of the antenna elements shown in FIG. 3 taken along line 180 of FIG. 3 in the direction of arrows A—A.

As an alternative, the wall pairs could be arranged without bilateral symmetry. For example, wall 149 could have a planar surface extending to gap 116 (FIG. 7). Walls 144, 146 and 148 then would be stepped, but would be dimensioned to provide adequate performance when paired with extended planar surface 149.

Returning to the preferred embodiment, the wall pairs couple and guide a radio frequency energy wave through mouth 162 to the outside of the array. Block 98 also forms top surfaces 174–176 arranged as shown. The wall pairs also define a tapered-surface plane 180 that bisects the wall pairs. Plane 180 is perpendicular to plane 118. Additional planes 182 and 183 parallel to plane 180 define a mid portion 185 of the wall pairs intersecting plane 180. At least mid portion 185 is covered with a conductive surface, and preferably the entire surface of the wall pairs is covered with a conductive surface, such as copper, gold or the like. Planes 182 and 183 may be moved toward or away from plane 180 in order to narrow or broaden mid portion 185. Points 186 and 187 lying at opposed ends of mouth 162 indicate the boundary of a section 188 of plane 180 formed by planes parallel to plane 118 and passing through points 186 and 187.

Tapered surfaces 140 and 141 may have a number of surface configurations. For example, an exponential curve, a smooth taper or a straight line taper can be used for surfaces 140 and 141, as well as the stepped taper shown in the drawings.

Figure 3:
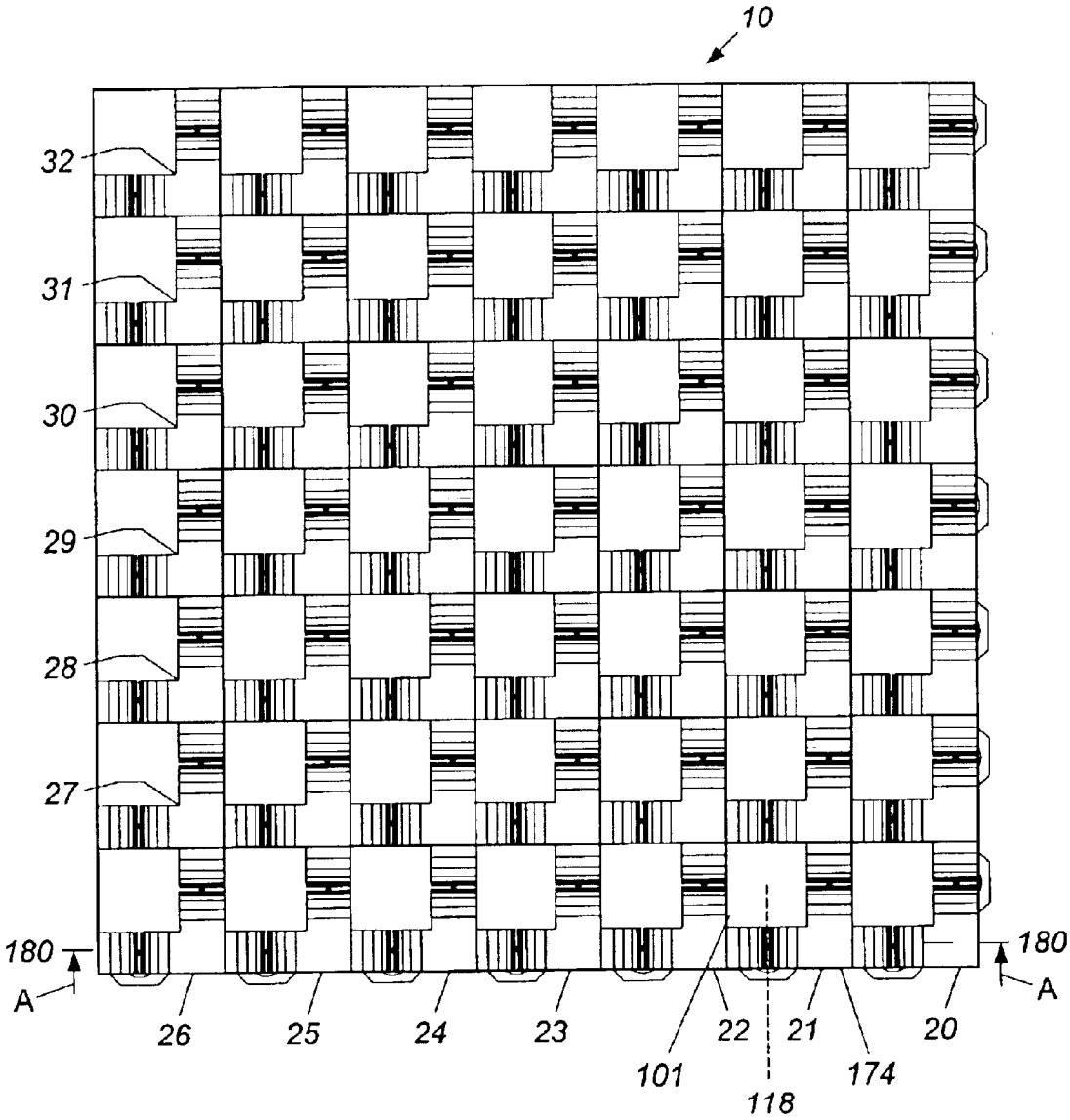
FIG. 3 is a top plan view of the array shown in FIG. 2 with the support module removed.
Figure 6:
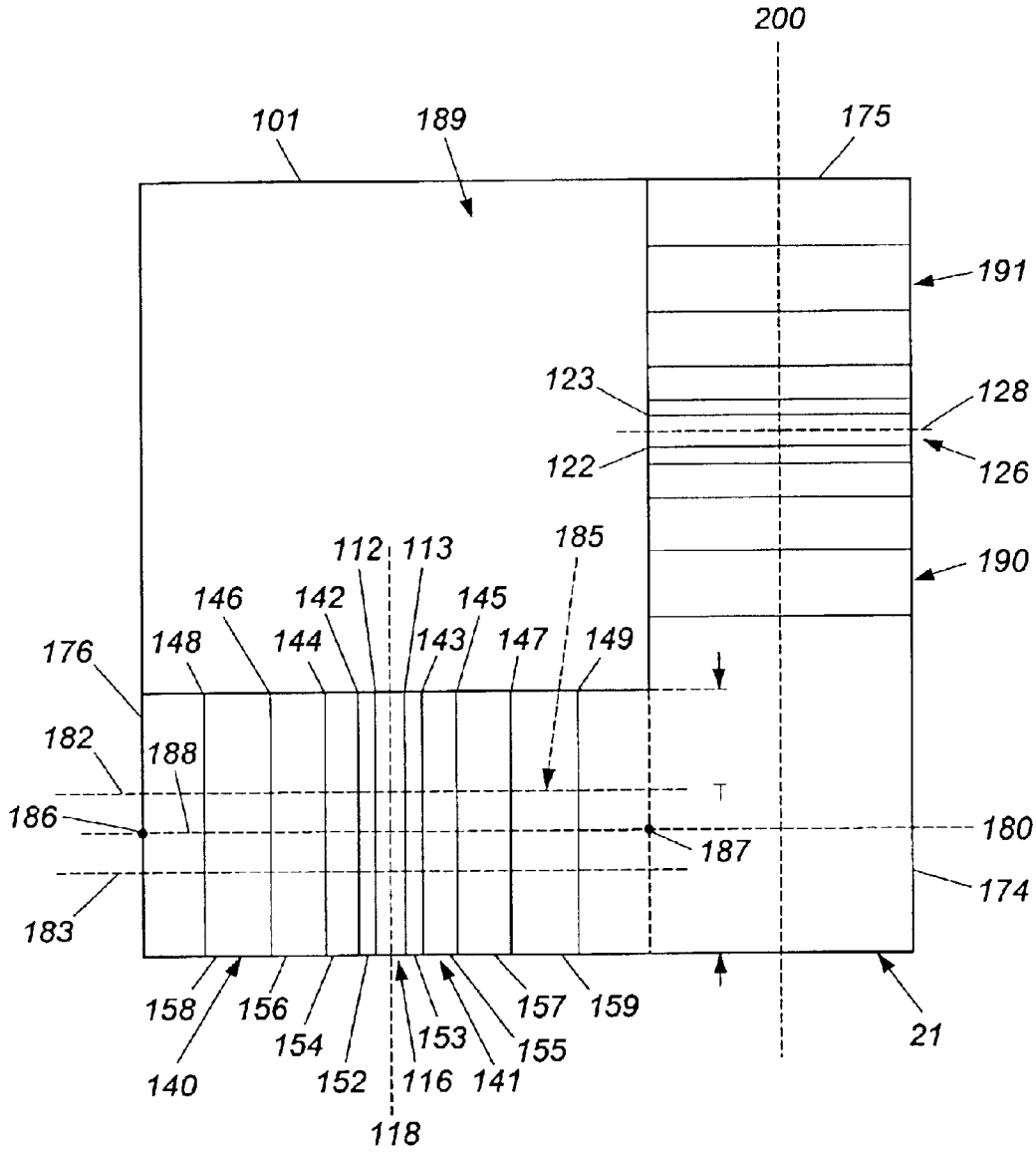
FIG. 6 is a top plan view of the antenna element shown in FIG. 5 with the connectors removed.

Block 98 also forms tapered surfaces 190 and 191 that are like tapered surfaces 140 and 141. Surfaces 190 and 191 define a tapered-surface plane 200 that does not intersect section 188 of plane 180. As shown in FIG. 3, no other tapered-surface plane in array 10 intersects section 188. As shown in FIGS. 3 and 6, the spaces (e.g., space 189) in each block formed by the area above the base top surfaces, such as surface 101, isolate the radio frequency waves guided by the various pairs of tapered surfaces. As shown in FIGS. 3 and 6, the spaces are rotated 90 degrees from the mid sections of the tapered surfaces, such as section 185, that guide the opposed edges of radio frequency energy or wave through mouth 162. Thus, at least the central portion of the opposed edges of the waves are guided by conductive material.

Figure 4:
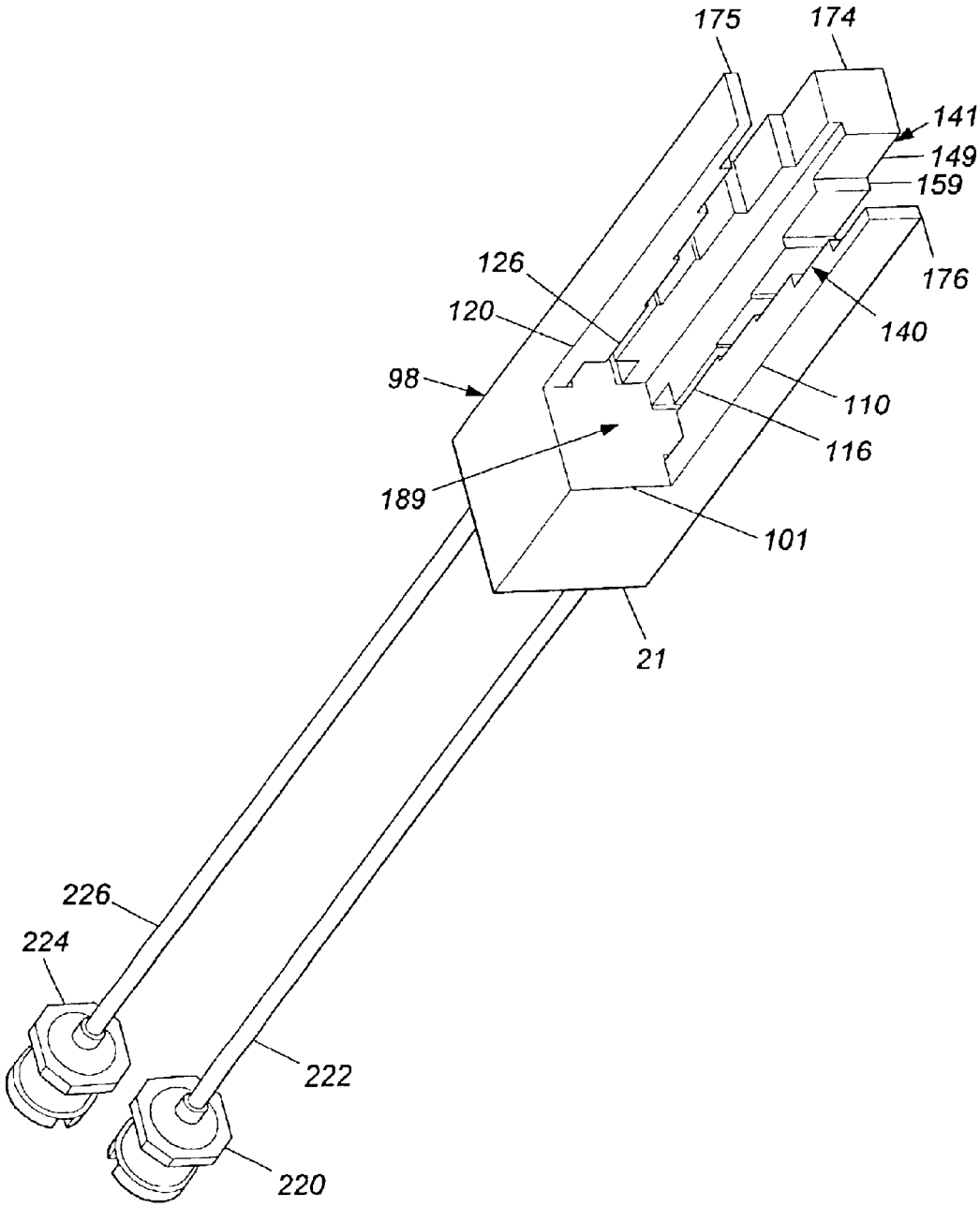
FIG. 4 is an isometric view of an exemplary antenna element from the array shown in FIG. 3, including connectors.
Figure 5:
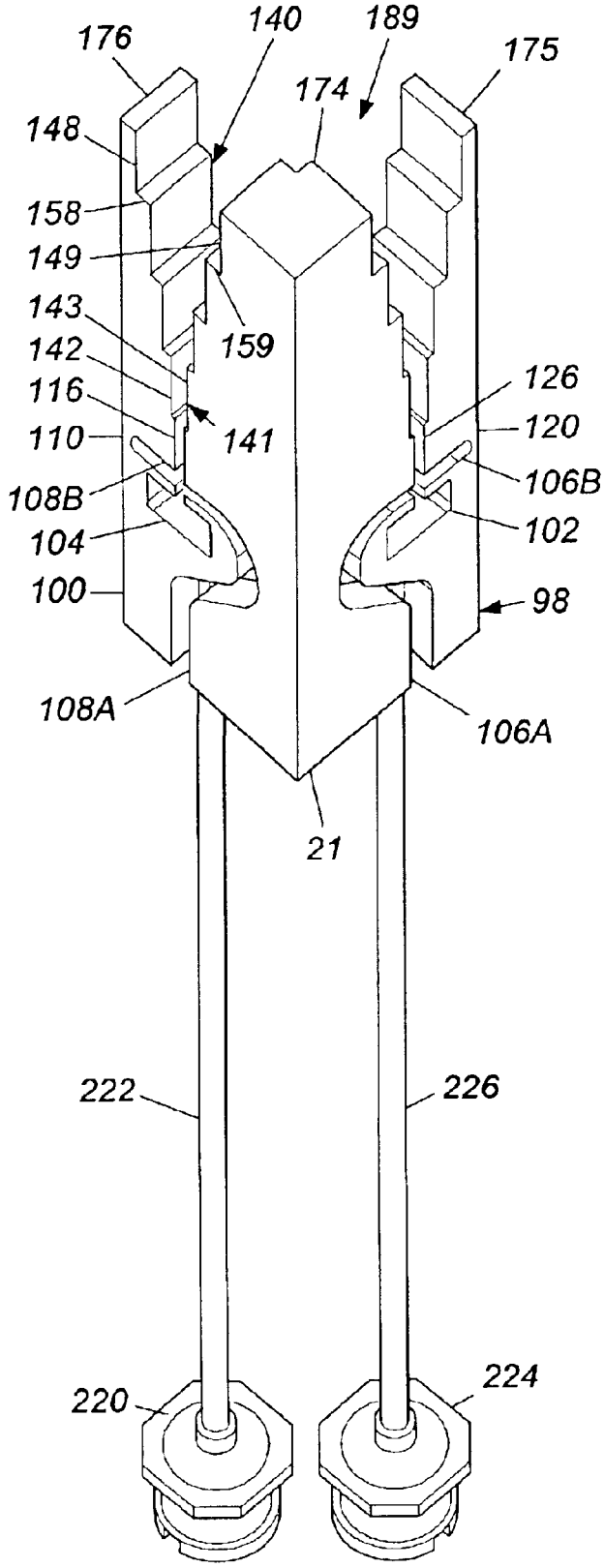
FIG. 5 is an isometric view of the antenna element shown in FIG. 4 take from a different angle.

Referring to FIGS. 4 and 5, antenna element 21 also includes a coaxial connector 220, such as a GPO™ connector, that couples a radio frequency energy signal to a coaxial cable 222. Another coaxial connector 224 couples another radio frequency energy signal to a coaxial cable 226. At the point at which cable 222 exits channel 108A, the outer shield conductor of the cable are stripped away so that only the center conductor (and maybe the insulation) is placed between surfaces 112 and 113 and in channel 108B. Cable 226 is arranged in a similar manner with respect to channels 106A and 106B.

Referring to FIG. 2, module 230 includes a board 232 that supports array 10. Another board 234 supports the GPO connectors. Posts 236 and 238 mechanically link boards 232 and 234. A frame 240 is mechanically linked to board 232 through posts 242–244.

The applicants have discovered that scan blindness of array 10 can be minimized or avoided by varying thickness T of the tapered surfaces with respect to mouth length M. Basically, the ratio of thickness T to mouth length M is increased until there is no substantial further increase in the high frequency limit of element 21 or array 10. This principle will be described in connection with FIG. 8 that illustrates an idealized unit cell corresponding to the tapered surfaces, such as 140 and 141.

In the preferred embodiment, width T is constant. However, T could vary along tapered surfaces 140 and 141 (e.g., T could be widest at wall pair 148, 149 and could become progressively narrower from wall pair 146, 147 to wall pair 144, 145 to wall pair 142, 143).

The field analysis method for an infinite periodic dual polarized array of ridge elements, such as the element shown in FIG. 8, in a square lattice will be described. Such arrays are found to possess very broadband and wide scan properties. With just nominal element spacing to avoid grating lobes, an array was designed to operate over a 5:1 frequency band and ±22.5° conical scan with an active VSWR≦2.

The singly polarized ridge parallel plate waveguide array was found to be broad band and capable of wide scan. Its field analysis and predicted E-plane scan performance is given in K. K. Chan and M. Rosowski: "Field Analysis of a Ridged Parallel Plate Waveguide Array", *Proc.* 2000 *IEEE International Conf. On Phased Array Systems and Technology*, Dana Point, May 2000, pp. 445–448. The array can be made dual polarized by arranging the ridge elements in a square lattice as shown in FIG. 2. A longitudinal section through a unit cell containing a network of multiple sections of the ridge element is given in FIG. 7. It provides a match from the 50 Ω feed section to the aperture radiating into free space. The preferred embodiment also can utilize feed sections having an impedance between 10 Ω and 377 Ω. The field analysis method involves finding the TE and TM modes of a given cross section of the ridge element. Mode matching is used to characterize the step junction between ridge sections and between the ridge element and free space with generalized scattering matrices (GSM). Floquet modes are used to represent the field in the free space section of the unit cell. The GSMs of the various junctions and the in-between uniform line sections are combined to yield the overall S-parameters of the ridge element in an array environment.

Figure 8:
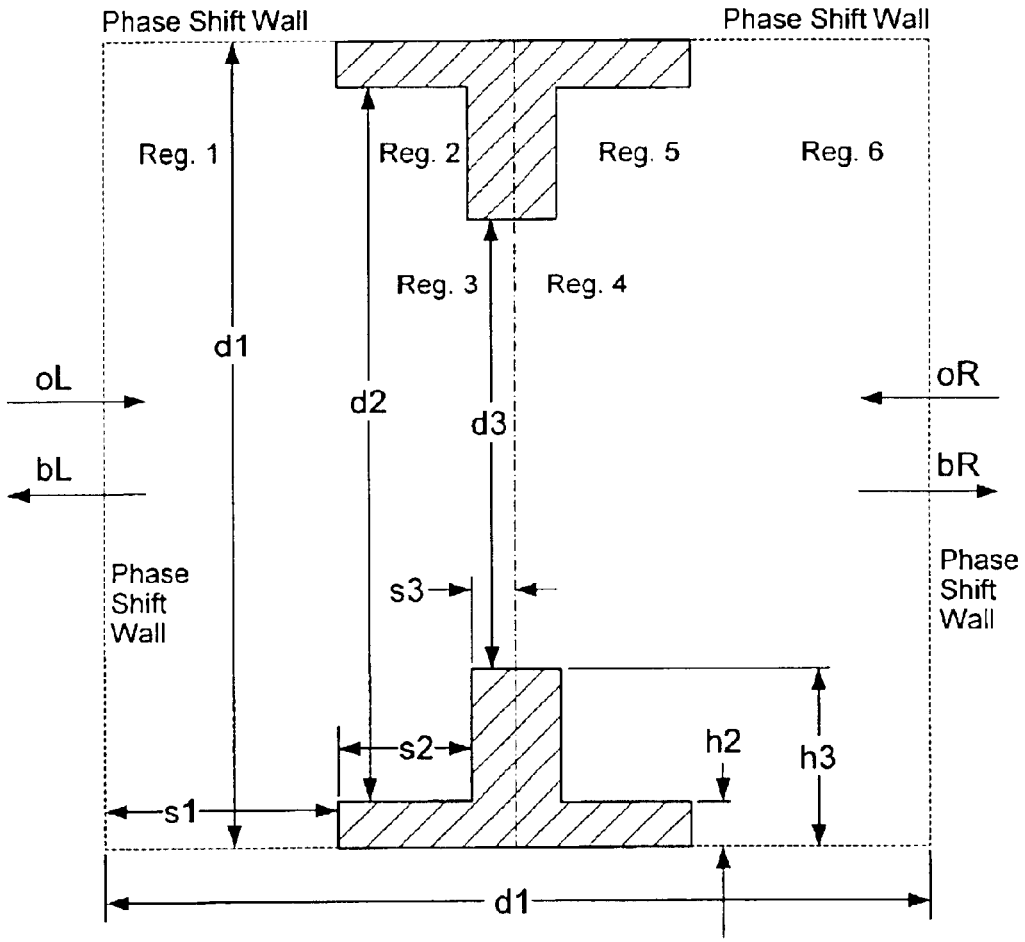
FIG. 8 is a fragmentary cross-sectional view of a unit cell element used to explain the construction and operation of the antenna element shown in FIG. 6.

The cross section of a ridge element section in a unit cell is depicted in FIG. 8. The ridge element of FIG. 8 is very similar to the tapered surface portion of element 21 (FIGS. 4–7). The element of FIG. 8 can be conveniently divided into N rectangular regions. The sidewalls of the unit cell are also phase shift walls. For TE modes, the scalar potential function for the first and last regions (i=1 & N), which have phase shift walls for the top and bottom walls, is $$\psi^i = \sum_{i=0,1,}^{M_i-1} \exp(-jk^i_{xhl}y)[-a^i_{hl}\exp(-jk^i_{xhl}x) + b^i_{hl}\exp(+jk^i_{xhl}x)]\exp(-jk_{zh}z)$$

$$k^i_{yhl} = k\sin\theta\sin\phi \pm 2\pi\frac{l}{d_i},\ (k^i_{yhl})^2 + (k^i_{xhl})^2 + (k_{zh})^2 = (k)^2,\ k = \frac{2\pi}{\lambda}$$

L terms are used to approximate the field in these end regions. The scalar potential function for the remaining regions (i=2, N−1), which have perfect electric conducting top and bottom walls, is written as $$\psi^i = \sum_{i=0,1,}^{M_i-1} \cos\left[\frac{m\pi(y-h_i)}{d_i}\right][a^i_{hm}\exp(+jk^i_{xhm}x) - b^i_{hm}\exp(-jk^i_{xhm}x)]\exp(-jk_{zh}z)$$

$$\left(\frac{m\pi}{d_i}\right)^2 + (k^i_{xhm})^2 + (k_{zh})^2 = (k)^2$$

$M_i$ terms are used to approximate the field in region I and are proportional to the y-dimension $d_i$. $(\theta, \phi)$ is the direction of scan. The coefficient $a^i$ and $b^i$ are used to set up an S-matrix of the junction between regions in the transverse X-direction. The generalized S-matrices of the N−1 step junctions and the uniform regions are combined to yield the cross section S-matrix $[S^x]$. Let the phase shift of the right hand sidewall with respect to the left hand sidewall be $\exp(+j\delta)$. Applying the phase boundary condition leads to the following homogeneous equation where I is a unit matrix and $a^L$ and $a^R$ are the coefficients on the left and right phase walls.

$$\begin{bmatrix} S^x_{11} & S^x_{12} - e^{-j\delta}I \\ S^x_{21} - e^{+j\delta}I & S^x_{22} \end{bmatrix}\begin{bmatrix} a^L \\ a^R \end{bmatrix} = \begin{bmatrix} 0 \\ 0 \end{bmatrix}$$

Setting the determinant to zero yields the required characteristic mode equation whose roots are the mode cutoff wave numbers. Similar equations are used to find the TM modes.

The fundamental mode is the quasi-TEM mode, which is the lowest propagating TE mode, and is labeled the $TE_1$ mode here. The line impedance normalized to that of free space may be plotted as a function of ridge gap spacing ratio, $d_3/d_1$, with half ridge width ratio, $s_3/d_1$, as a parameter and $d_1$ is the cell size. Once the line impedance is specified, these useful curves provide the cross section dimensions since $$s_1 = \frac{d_3}{2},\qquad s_2 = \frac{d_1}{2} - s_3 - s_1,\quad d_2 = d_1 - 2s_3$$

-continued $$h_2 = \frac{d_1 - d_2}{2},\quad h_3 = h_2 + \frac{d_2 - d_3}{2}$$

Figure 9:
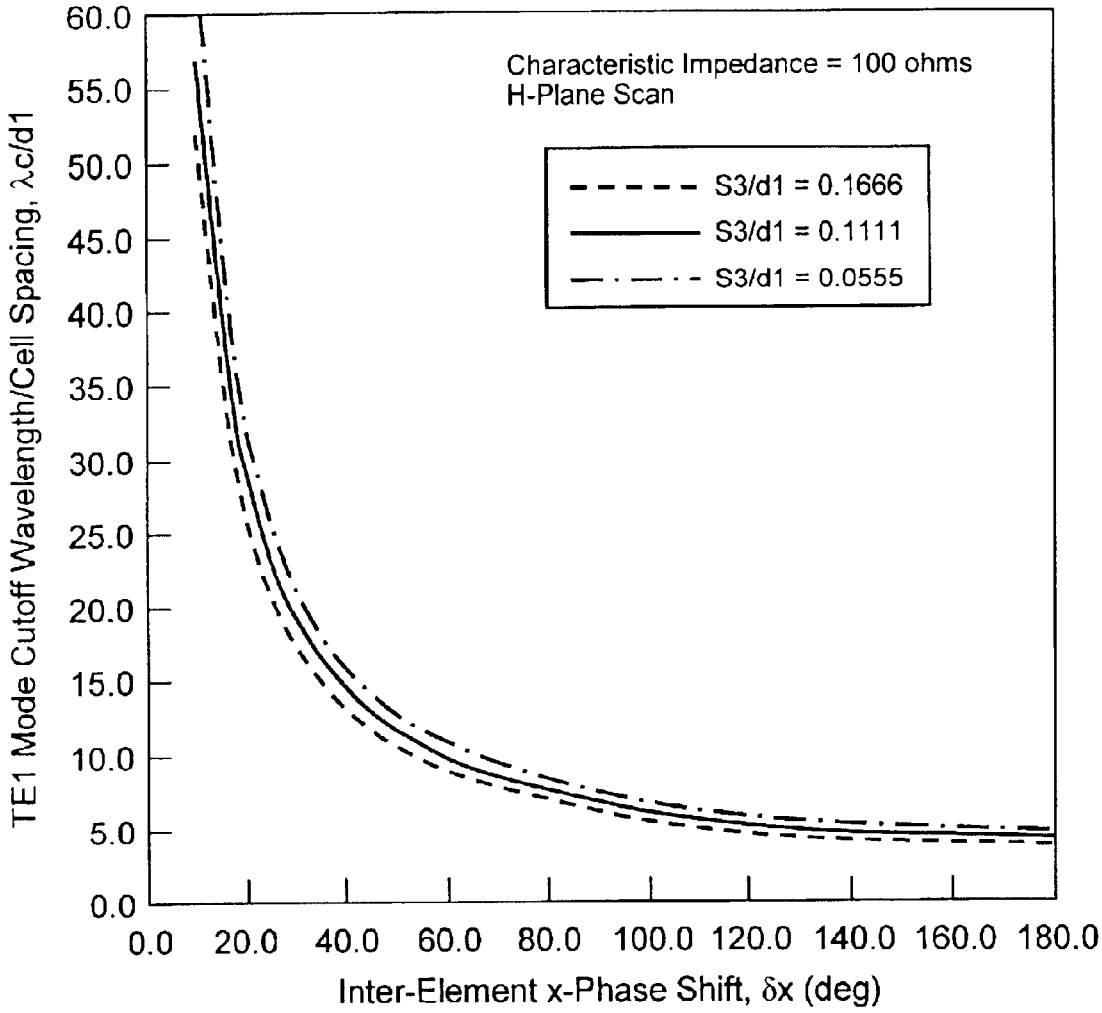
FIG. 9 is a graph of cutoff wavelength of a TE1 mode for an H-plane scan of the cell element shown in FIG. 8 where the characteristic impedance of the feed section for the element is 100 ohms.
Figure 10:
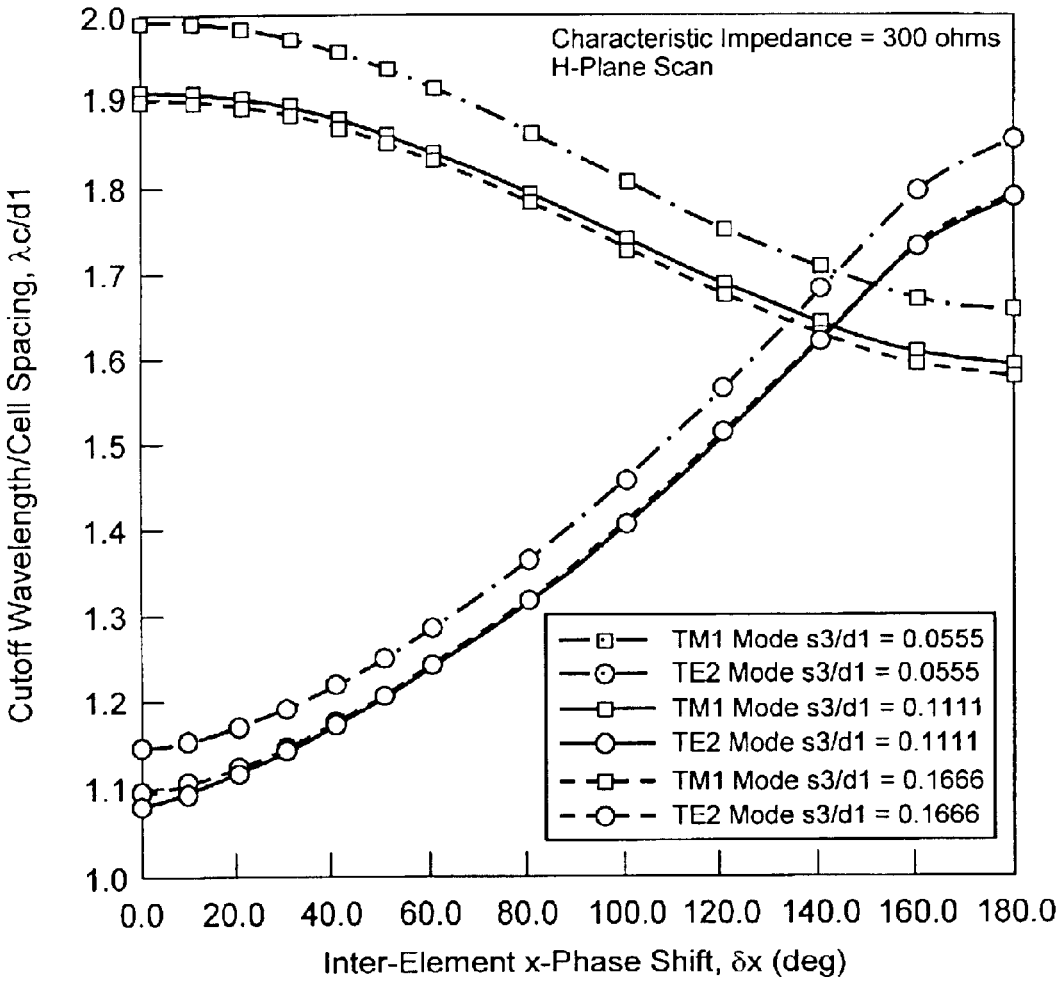
FIG. 10 is a graph of cutoff wavelengths of higher order modes for an H-plane scan of the cell element shown in FIG. 8 where the characteristic impedance of the feed section for the element is 300 ohms.

When the array is scanned in the H-plane, the $TE_1$ mode has a cutoff wavelength $\lambda_c$, which sets the low frequency limit. However it is relatively long as seen in FIG. 9 where the variation of $\lambda_c/d_1$ for a 100 Ω line with inter-element phase shift is plotted. The high frequency limit equals $c/\lambda_c$ where $\lambda_c$ is cut-off for higher order modes. The normalized cutoff wavelength, $\lambda_c/d_1$, as a function of inter-element phase shift is shown in FIG. 10 for H-plane scan. The line impedance in FIG. 10 is 300 Ω. A close examination of the behavior of the higher order modes leads to the following observations.

The high frequency limit increases as the width of the ridge increases.

There is an optimum value in the ridge width beyond which there is no further increase in the high frequency limit (i.e., the bandwidth).

The high frequency limit increases as the cell size decreases.

The high frequency limit increases as the line impedance decreases.

Arrays with elements having thin ridges need close cell spacing to maintain broadband operation. Reducing the element population density significantly by using thick ridges is the preferred approach. The common practice of flaring the element aperture out to the cell size dimension may not be a good design procedure. Depending on the cell size, higher order modes may be generated and propagated within the element, thus deteriorating the scan element pattern.

Figure 11:
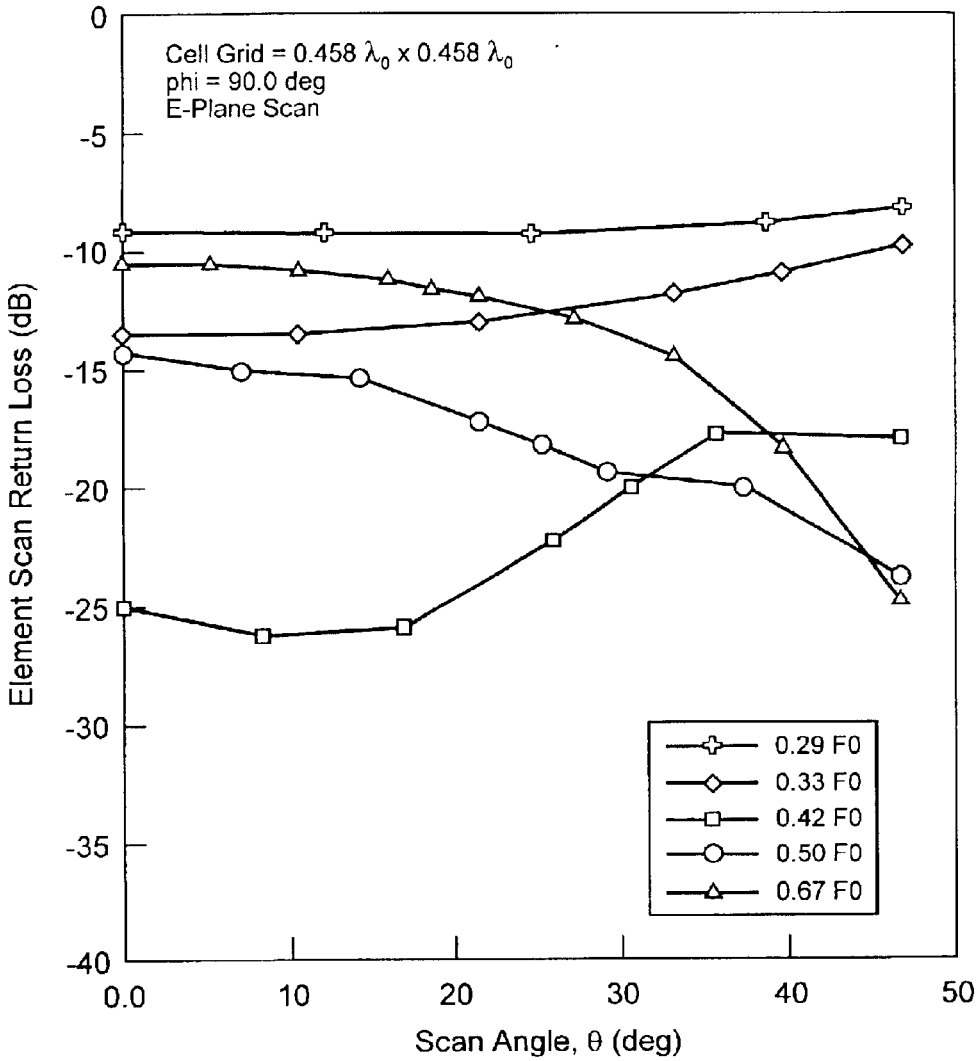
FIG. 11 is a graph of an active impedance match of the element shown in FIG. 8 under an E-plane scan from 0.29F0 to 0.67F0, where FO is a nominal RF frequency.
Figure 12:
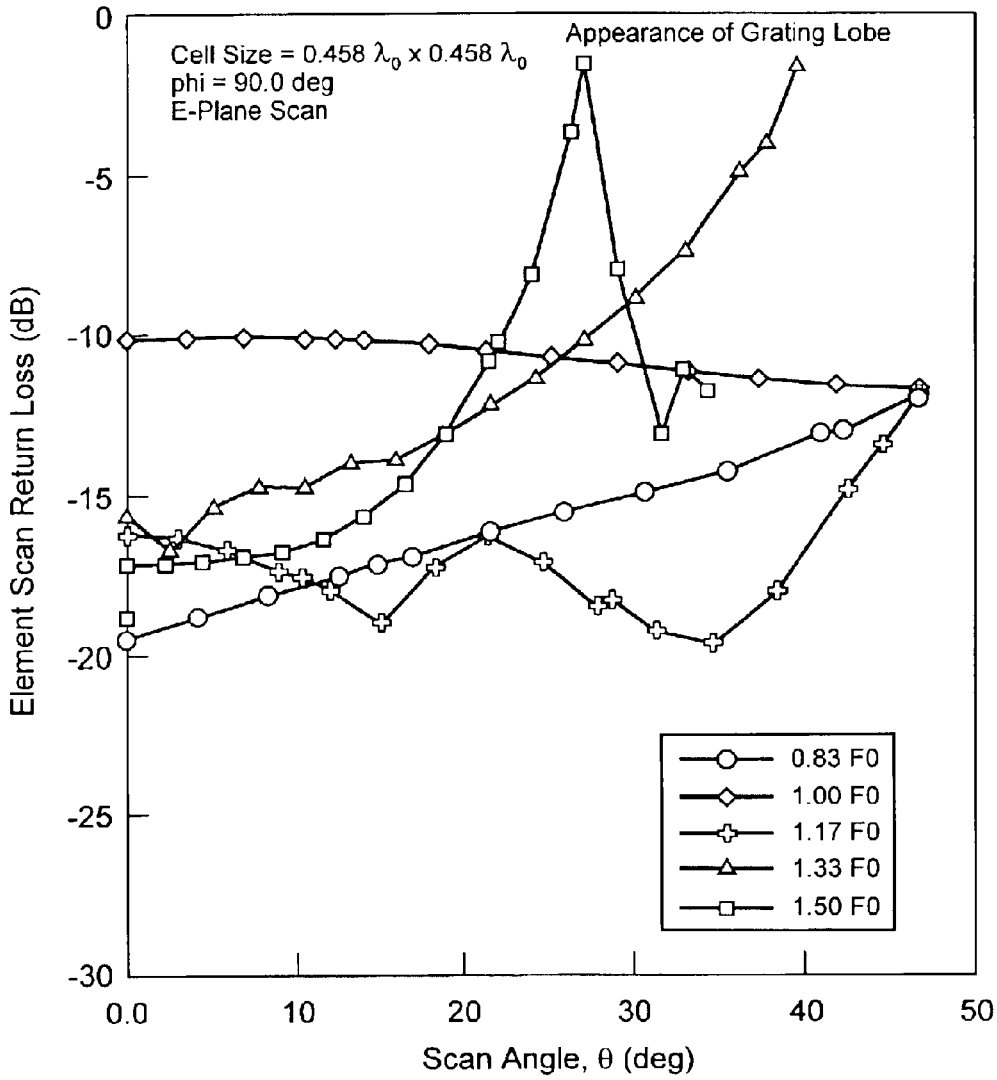
FIG. 12 is a graph of active impedance match of the element shown in FIG. 8 under an E-plane scan for 0.83F0 to 1.50F0.

Using a cell spacing of $0.458\lambda_0$, an array was designed to operate from $0.3F_0$ to $1.5F_0$ with a conical scan of ±22.5°. This relatively large element spacing is needed to facilitate the connection to the T/R modules. To avoid spikes in the element match, no higher order modes are allowed to propagate in any of the ridge sections. The active match of the ridge element under H- and E-plane scan is plotted in FIGS. 11 and 12 for various frequencies across the operating band. As can be seen, a scan VSWR≦2 is maintained over the band. Even broader band and/or wider scan can be realized by reducing the cell size.

While the invention has been described with reference to one or more preferred embodiments, those skilled in the art will understand that changes may be made and equivalents may be substituted without departing from the scope of the invention. In addition, many modifications may be made to adapt a particular step, structure, or material to the teachings of the invention without departing from its scope. Therefore, it is intended that the invention not be limited to the particular embodiment disclosed, but that the invention will include all embodiments falling within the scope of the appended claims.

What is claimed is:

1. An antenna array comprising a plurality of antenna elements cooperating to communicate radio frequency waves, each element comprising:

an element structure having a gap arranged to couple radio frequency energy, the element structure defining a gap plane bisecting the gap;

a first tapered surface and a second tapered surface extending from the element structure to a mouth and arranged to couple the radio frequency energy through the mouth, said first and second tapered surfaces defining a first section of a first tapered-surface plane perpendicular to the gap plane and bisecting the first and second tapered surfaces, a first mid portion of the first tapered surface and a second mid portion of the second tapered surface, the first and second mid portions intersecting the first tapered-surface plane, and an outer boundary of the first section at the periphery of the mouth, the other elements in the array being arranged such that no other tapered-surface plane of another pair of tapered surfaces in the array intersects the first section; and a conductive surface arranged to cover at least the first and second mid portions.

2. An array as claimed in claim 1, wherein the element structure comprises parallel element structure walls defining said gap.

3. An array as claimed in claim 1, wherein the first and second tapered surfaces comprise pairs of parallel walls on opposite sides of said gap plane.

4. An array as claimed in claim 3, wherein the parallel walls comprise stepped surfaces intersecting said first tapered-surface plane and parallel to said gap plane.

5. An array as claimed in claim 4, wherein the step surfaces are perpendicular to the first tapered-surface plane.

6. An array as claimed in claim 1, wherein the first and second tapered surfaces have bilateral symmetry with respect to the gap plane.

7. In an antenna array comprising a plurality of antenna elements cooperating to communicate a plurality of radio frequency waves, a method of generating the waves comprising:

guiding at least the central portion of opposed edges of the waves with a conductive material; and isolating the waves from each other, wherein the guiding comprises guiding in stepped increments.

8. A method as claimed in claim 7, wherein the isolating comprises providing structure defining open spaces at the edges of the waves rotated 90 degrees from the opposed edges guided by the conductive material.

9. An antenna array comprising a plurality of antenna elements cooperating to communicate radio frequency waves, at least a majority of the elements comprising:

an element structure having a gap arranged to couple radio frequency energy, the element structure defining a gap plane bisecting the gap;

a surface having a predetermined thickness parallel to the gap plane, said surface extending from the element structure to a mouth defining a mouth length, the surface being arranged to couple the radio frequency energy through the mouth, the ratio of the predetermined thickness to the mouth length being such that there would be no substantial decrease in the high frequency limit of the array if the ratio were increased, wherein the surface comprises a pair of stepped surfaces.

10. An array as claimed in claim 9, wherein at least a portion of the surface comprises conductive material.

11. In an antenna array comprising a plurality of antenna elements cooperating to communicate radio frequency waves, at least a majority of the elements comprising an element structure having a gap arranged to couple radio frequency energy, the element structure defining a gap plane bisecting the gap, and further comprising a surface having a predetermined thickness parallel to the gap plane, said surface extending from the element structure to a mouth defining a mouth length, the surface being arranged to couple the radio frequency energy through the mouth, a method of tuning the antenna elements by increasing the ratio of the predetermined thickness to the mouth length until there is no substantial decrease in the high frequency limit of the array, wherein the surface comprises stepped surfaces.

12. An array as claimed in claim 11, wherein at least a portion of the surface comprises a conductive material.

* * * * *